United States Patent [19]

Hathaway

[11] Patent Number: 4,721,295

[45] Date of Patent: Jan. 26, 1988

[54] APPARATUS AND PROCESS FOR SEPARATING STACKS OF SHEETS INTO BUNDLES

[75] Inventor: John M. Hathaway, Green Bay, Wis.

[73] Assignee: Kimberly-Clark Corporation, Neenah, Wis.

[21] Appl. No.: 895,777

[22] Filed: Aug. 12, 1986

[51] Int. Cl.[4] ..... B65H 41/00

[52] U.S. Cl. ..... 270/52.5; 270/39; 493/433; 493/412; 493/357; 225/100

[58] Field of Search ..... 270/39–41, 270/47, 52, 52.5, 21.1, 95; 225/1, 3, 4, 93, 97–98, 100–101, 103–106; 493/379–381, 386, 390, 357–360, 398, 361–362, 364, 372, 429–430, 424, 433, 409–414

[56] References Cited

U.S. PATENT DOCUMENTS

| | | | |
|---|---|---|---|
| 843,781 | 2/1907 | Wheeler | 270/39 |
| 902,838 | 11/1908 | Sauter | 270/39 |
| 1,290,801 | 1/1919 | Teall | 270/39 |
| 2,098,427 | 11/1937 | Menschner | 493/412 |
| 2,631,846 | 3/1953 | Sabel | 270/39 |
| 2,855,833 | 10/1958 | Rugg et al. | 270/95 |
| 3,044,766 | 7/1962 | Banks | 493/433 |
| 3,163,413 | 12/1964 | Franke et al. | 270/39 |
| 3,611,887 | 10/1971 | Shibanuma et al. | 270/95 |
| 3,640,521 | 2/1972 | Hutley | 493/412 |
| 3,883,131 | 5/1975 | Anderson, Jr. et al. | 493/433 |
| 4,010,881 | 3/1977 | von Wietersheim et al. | 225/100 |
| 4,205,836 | 6/1980 | Nystrand | 493/357 |
| 4,396,336 | 8/1983 | Malamood | 270/95 |
| 4,406,650 | 9/1983 | Felix | 493/433 |
| 4,494,741 | 1/1985 | Fischer et al. | 493/433 |
| 4,508,527 | 4/1985 | Uno et al. | 225/103 |
| 4,618,340 | 10/1986 | Meschi | 493/412 |
| 4,650,447 | 3/1987 | Meschi | 493/412 |

FOREIGN PATENT DOCUMENTS

| | | | |
|---|---|---|---|
| 187344 | 7/1986 | European Pat. Off. | 225/100 |
| 104870 | 6/1983 | Japan | 493/412 |

*Primary Examiner*—E. H. Eickholt

*Attorney, Agent, or Firm*—Gregory E. Croft; Donald L. Traut; Jeremiah J. Duggan

[57] ABSTRACT

Method and apparatus for automatically separating interfolded sheets from an interfolder into bundles having a predetermined count. Two separator plates are inserted into the stack of sheets at the proper sheet count, defining a bundle. An elevator and one of the separator plates take the bundle away from the discharge area of the interfolders.

17 Claims, 10 Drawing Figures

APPARATUS AND PROCESS FOR SEPARATING STACKS OF SHEETS INTO BUNDLES

BACKGROUND OF THE INVENTION

This invention relates to apparatus and methods for separating a stack of sheets into bundles.

This invention is particularly applicable for use with interfolding of paper sheets in the formation of a stack of interfolded sheets; and the forming of discrete bundles, with each bundle having the same number of sheets.

The interfolding of sheets is well known. U.S. Pat. No. 2,761,677 Rutkus et al. teaches a rotary interfolder, for forming a stack of interfolded sheets. Similarly U.S. Pat. No. 4,190,241 to Krueger teaches another apparatus for forming a stack of interfolded sheets. In the Rutkus patent the stack of sheets is fed to an elongated chute accumulator. The stack is eventually fed to a stack separating mechanism displaced some distance from the stack forming area which stack forming area is at the discharge of the interfolding apparatus. The Krueger patent teaches the use of an elevator to remove an exact number of C-folded sheets. While the elevator is removing the stack, an accumulator plate continues to accumulate additional sheets until the elevator returns. U.S. Pat. No. 2,675,747 Greiner et al. teaches a vertically moving accumulator elevator. A cutting separator plate and pusher combination cuts the sheet bonds and pushes the bundle sideways off the elevator. U.S. Pat. No. 4,508,527 to Uno et al. teaches another method of separating folded sheets of paper into individual bundles.

SUMMARY OF THE INVENTION

This invention includes apparatus and processes for separating a stack of folded sheets into individual, or discrete, bundles of sheets. The apparatus of the invention includes a first separator plate insertable into the stack, and a second separator plate insertable into the stack above the first separator plate. The first and second plates are capable of separating a bundle of sheets from the stack by bringing both plates into the stack and moving at least one of the plates such that facing surfaces of the first and second plates move away from each other as they continue in facing relationship. Preferably the first and second plates are oriented such that they enter the stack from opposite sides, and usually the plates are parallel to each other.

It is preferred that the apparatus include a discharge chute below the first and second plates for containment of the sides of the stack and the bundles being removed from the stack. The first plate and the corresponding chute sidewall are cooperatively configured such that the first plate may travel downwardly in the discharge chute and withdraw from the chute while in its downward position. The second plate and the chute sidewall corresponding to it may be similarly configured.

The apparatus preferably includes an elevator having a platform which is below the first separator plate when the plate is in the stack, the elevator being capable of up and down movement below the first separator plate. Another way of describing the elevator movement is that it is reciprocal movement, in receiving the stack in one location and transporting it in a reciprocal motion for delivery at a second location. At the second location the apparatus preferably includes pushing means for pushing the stack off the elevator. The first plate and the elevator are capable of cooperatively holding a portion of the stack, defining a bundle, between them while cooperatively transporting the bundle toward the second location.

The invention can be considered apparatus for receiving interfolded sheets directly from an interfolder as the sheets are being formed into a stack, and downwardly separating, from the stack folding area, a bundle of a predetermined number of sheets. As will be seen in the detailed description following, the lower position of the elevator is that in which a bundle is pushed off the elevator and onto a take-away device, such as a conveyor. The stack receiving position of the elevator is achieved when it is raised into proximity with the lower portion of the stack of sheets being formed. The elevator movement typically occurs within the discharge chute in those embodiments where the chute is used.

The invention includes a process for separating a stack of folded sheets into bundles. The process includes the steps of inserting a first separator plate into the stack, inserting a second separator plate into the stack above the first separator plate, and moving at least one of the plates such that facing surfaces of the first and second plates move away from each other as they continue in their facing relationship. Where the first separator plate is moved downwardly in order to effect moving the plates away from each other, the elevator is cooperatively lowered with it such that the elevator and the first plate hold a bundle between them, whereby the bundle is effectively separated from the stack. As the bundle, the plate, and the elevator are being lowered, the top sheet of the bundle is pulled away from the bottom sheet of the overlying stack, which is positioned on the second separator plate. The top sheet of the bundle is thus separated from the lower sheet of the stack. The first plate may then be withdrawn laterally from the chute and raised to a position slightly under the plane of the second plate, and reinserted laterally under the second plate.

Meanwhile, the elevator has been lowered to its lower-most position. There a pusher pushes the bundle off the elevator and onto a take-away conveyor. After the elevator has been unloaded, it is raised to a position directly adjacent the bottom surface of the first plate. The first and second plates are withdrawn, thereby depositing the stack onto the elevator.

DETAILED DESCRIPTION OF THE ILLUSTRATED EMBODIMENTS

Figure 1:
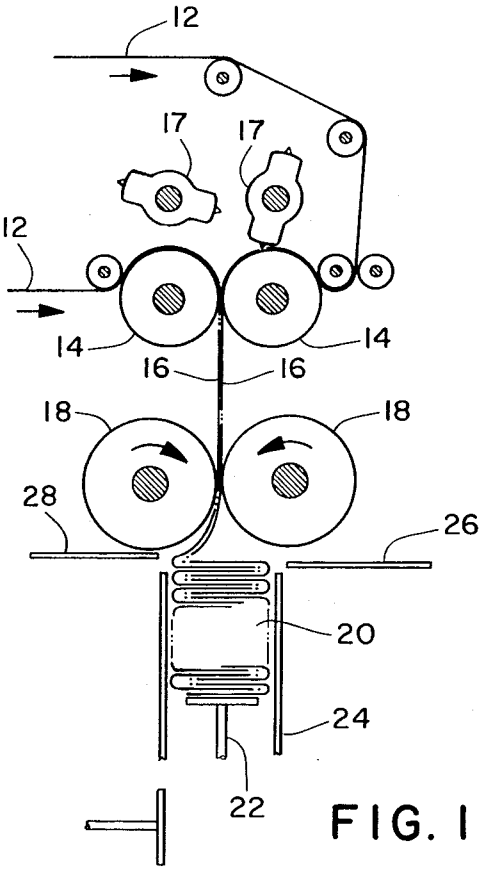
FIG. 1 is a side elevation view of folding and separating apparatus of the invention.

Referring now to FIG. 1, two webs 12 of paper are fed over a series of guide rolls onto anvil rolls 14 where they are cut into individual sheets 16 by cutters 17. The individual sheets preferably have small uncut areas between them at places where cutter knives are discontinuous. These uncut areas provide low strength bonds for the handling of the thus sheeted web through the balance of the process. The timing of the cutters is such that the location of cuts on the webs 12 alternates, so that each cut on one web is adjacent an uncut area on the other web, as is conventionally practiced in the cutting and folding of interfolded sheets. The two webs are joined together at the line of convergence of anvil rolls 14. The joined webs are then fed to folding rolls 18 where they are folded in the conventional manner and formed into an interfolded stack 20. Stack 20 is delivered to elevator 22 in chute 24. As the stack is formed, elevator 22 is lowered so that the top of the stack, which receives the incoming sheets from the folding rolls 18, remains at a relatively constant elevation.

Figure 3:
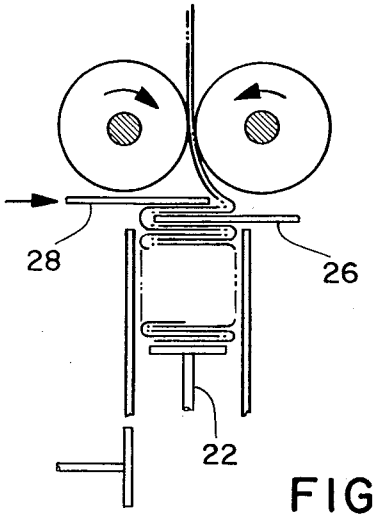
FIG. 3 is a side elevation as in FIG. 2 and showing the insertion of a second separator plate.
Figure 2:
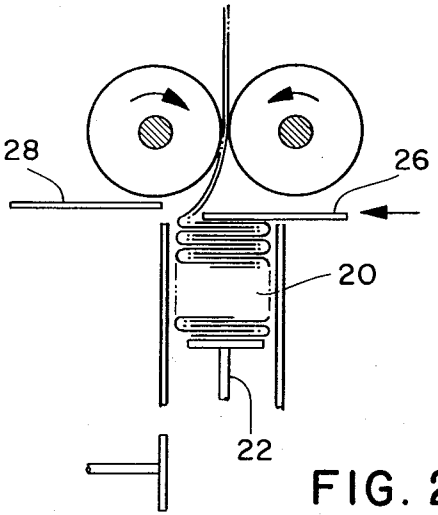
FIG. 2 is a side elevation view of the folding and separating section of the apparatus of FIG. 1 and showing the insertion of a first separator plate into the stack.

When the desired number of sheets has been received in stack 20, first separator plate 26 is inserted into the stack as the fold is being pulled to the left, as seen in FIG. 2. Second separator plate 28 moves into stack 20 above first separator plate 26 shortly after first separator plate 26 is inserted into the stack and while the fold is being pulled to the right as seen in FIG. 3. Simultaneous insertion of plates 26 and 28 is possible, with proper timing, as between FIGS. 2 and 3, but is not preferred.

When both plates have been inserted into the stack, elevator 22 and first separator plate 26 move downwardly, separating bundle 30 from the remainder of the stack, which is continuing to be formed on top of second separator plate 28. See FIG. 4. As seen in FIG. 5 the sidewall 24A of chute 24 has vertical slots 25 extending downwardly from an upper locus on sidewall 24A. First separator plate 26 has cooperatively designed slots 32 and fingers 33 which fit into the slots 25 of sidewall 24A for sliding movement therein.

Figure 4:
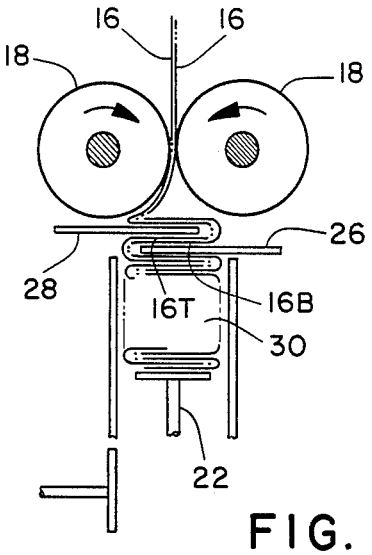
FIG. 4 shows the separator plates in the stack, and shows the cut and bonded sheet ends being connected by dots.
Figure 5:
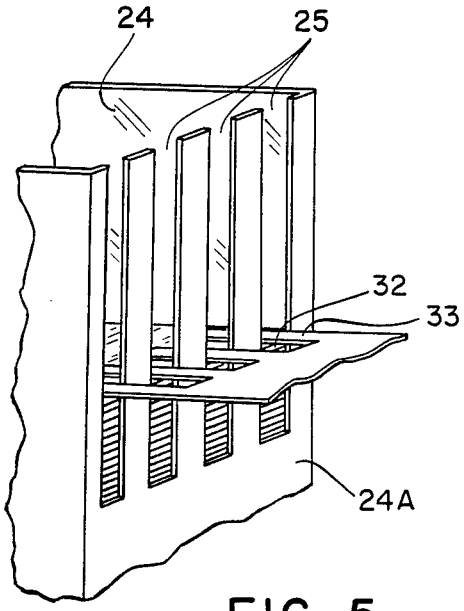
FIG. 5 is a cut-away partial side elevation view of the chute and the first separator plate, showing the cooperative design of slots and fingers in the chute sidewall and the separator plate.
Figure 6:
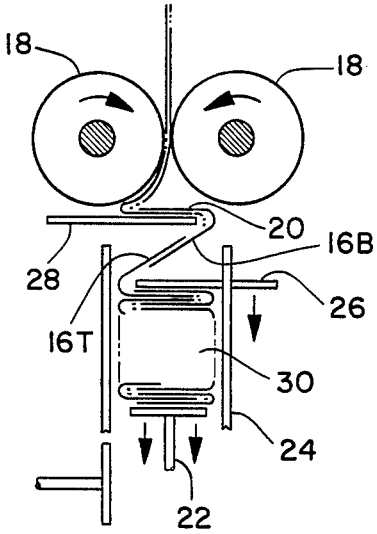
FIG. 6 is a side elevation view as in FIG. 3 and showing a bundle being lowered on the elevator.
Figure 7:
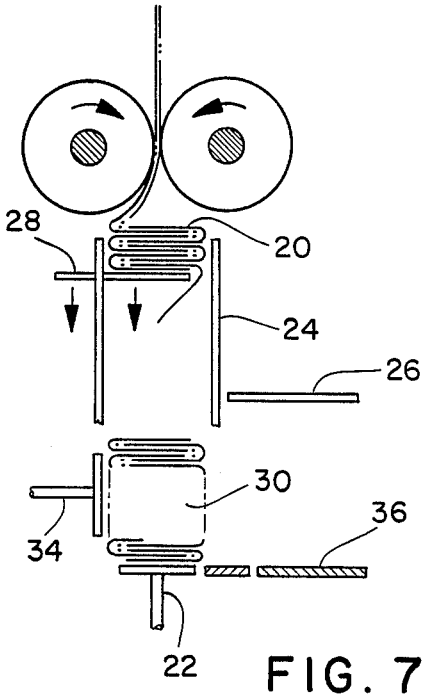
FIG. 7 is a side elevation view as in FIG. 6 with the bundle having been lowered to the location of discharge to a take-away conveyor and the first separator plate having been withdrawn from the chute.

As seen in FIG. 4, the top half of the top sheet 16T in the bundle and the bottom half of bottom sheets 16B, in the stack 20 which is continuing to be formed on second separator plate 28, are between separator plates 26 and 28. As plate 26 and elevator 22 are cooperatively lowered as seen in FIG. 6, first separator plate 26 and elevator 22 confine the bundle 30 between them. In the process of lowering the bundle, top sheets 16T is pulled away from bottom sheet 16B. One of the primary functions of first separator plate 26 is to securely hold the top of the bundle so that the separation of sheet 16T from sheet 16B is assured. When sheet 16T has fully separated from sheet 16B, downward movement of first separator plate 26 may be stopped and plate 26 withdrawn from chute 24 as seen in FIG. 7. Meantime elevator 22 is further lowered until the top of bundle 30 is clear of chute 24, or is adjacent an appropriately sized opening in chute 24. Pusher 34 pushes the bundle 30 off of elevator 22, and onto a take-away conveyor 36. First separator plate 26 is raised to its original starting position, and reinserted under second separator late 28, as in FIG. 9, thereby capturing the lower half of the bottom sheet 16B in the stack 20 which is continuing to be formed. Elevator 22 is then raised to a position that is just below first separator plate 26. First and second separator plates 26 and 28 are then withdrawn, preferably simultaneously, from the stack, as in FIG. 10, leaving the stack on elevator 22, and thus completing the cyle.

During the forming of the stack on second separator plate 28, plate 28 may be lowered, as seen in FIGS. 7–10, so that the sheets being received are received at approximately a consistent height, just as when the stack is being received by elevator 22. To accommodate lowering of plate 28, plate 28 and the corresponding sidewall of chute 24 may have slots and fingers similar to those seen in FIG. 5 and correspondingly described for plate 26 and sidewall 24A.

Separator plates 26 and 28, and elevator 22 have smooth surfaces for easy sliding with respect to the sheets being folded. The smooth surfaces are significant to their compatibility with the sliding steps, where the plates slide into the stack and out of the stack, and where the bundle slides as it is pushed off the elevator.

The process, in its most comprehensive form is a process for forming a stack of interfolded sheets and separating the stack into bundles. As envisioned this way, the first step of the invention is interfolding sheets on an interfolder and forming a stack of the interfolded sheets on an elevator which has been raised to the proximity of the discharge location of the interfolder. The elevator has a line of movement which is basically up and down. As sheets are added to the stack by the interfolder the elevator is lowered along its line of movement so that the top of the stack, which receives the incoming sheets from the interfolder, remains at a relatively consistent elevation. When the appropriate number of sheets has been received in the stack, the first separator plate is inserted into the stack, thereby defining a bundle between the first separator plate and the elevator. Immediately after inserting the first separator plate, a second separator plate is inserted into the stack above, and adjacent, the first plate. The stack of sheets continues to accumulate on the second plate, and the second plate is lowered, as necessary, to accommodate receiving sheets from the interfolder at approximately a consistent height.

Meantime, the elevator and the first plate are lowered cooperatively, and at a faster rate, such that the bundle is held between them and is separated thereby from the stack. When the first plate has moved downwardly an adequate distance to separate the top sheet of the bundle from the underlying sheet of the remainder of the stack, which remains on the second plate, the downward movement of the first plate is stopped while the lowering of the elevator is preferably continued to a lower position. The first plate is withdrawn from the line of movement of the elevator, is raised to a position just below the plane defined by the second plate, and is reinserted under the second plate; thereby positioning the bottom half of the bottom sheet of the accumulating stack between the first and second plates. The elevator is raised to a position just below the first plate. The first and second plates are then withdrawn from the stack, such that the forming stack is deposited on the elevator. The elevator then lowers, as needed, such that sheets are continuing to be received at approximately a consistent height, until enough sheets have been received to form the next bundle, at which time the process of removing the bundle is repeated.

An advantage of using two separator plates, as at 26 and 28, simultaneously in the stack, is that the first separator plate 26 is able to cooperate with elevator 22 and confine the top sheet, of the separating bundle, with the bundle. This ensures that the top sheet 16T stays with bundle 30. This is particularly significant where there is seen to be substantial surface-to-surface friction between the sheets. It is also a significant factor where the sheets have minor interconnecting bonds between them. In that event, the bonds are broken by pulling the sheets apart. In so doing, the restraint of the sheets being pulled apart—in the bundle by plate 26, and in the stack by plate 28—is a significant feature in assuring that sheet 16T remains with bundle 30, and that sheet 16B remains as part of the stack 20. It is entirely possible, and acceptable, in some embodiments of this invention that a small number of sheets, typically not more than 2 whole sheets, be disposed between the first and second separator plates along with the partial sheets shown in, for example, FIG. 6.

Figure 8:
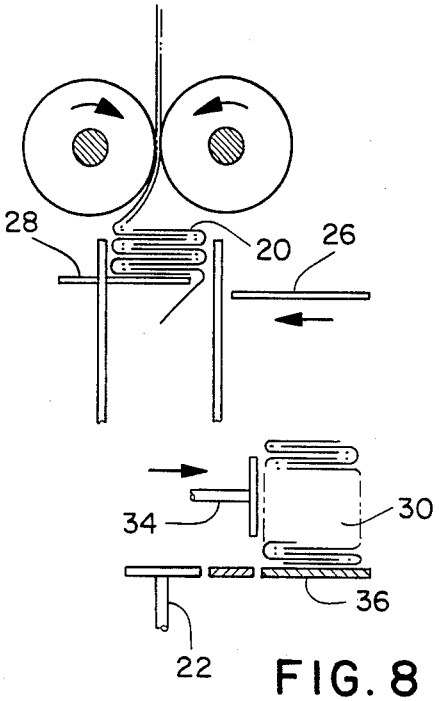
FIG. 8 shows the bundle being removed from the elevator to the take-away conveyor, the first separator plate having been raised to its starting position.
Figure 9:
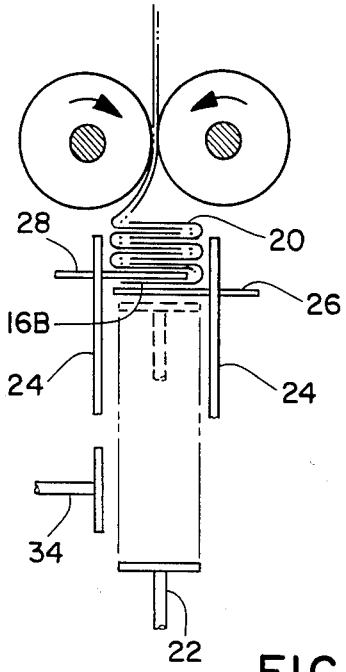
FIG. 9 shows the first separator plate having been reinserted into the chute, and the elevator being raised to a position just below the separator plates.
Figure 10:
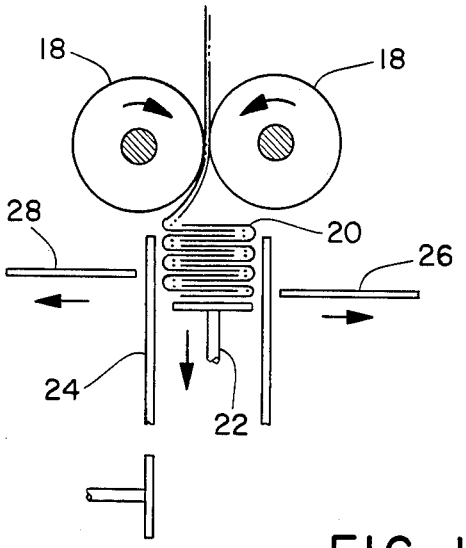
FIG. 10 shows the stack having been delivered onto the elevator by removing both separator plates from the stack.

Elevator 22 has a lowermost position at which the bundles are pushed off it by pusher 34, as in FIGS. 7 and 8. Elevator 22 also has a stack receiving position; namely a position at which it is receiving the stack from separator plates 26 and 28 as is seen in FIG. 11. A somewhat higher position is used at certain times in the overall process, such as at start-up. The stack receiving position, as seen in FIG. 9, depends on the relative times for (a) the elevator to deliver a bundle and return to the stack, and (b) the amount of time required to form a sufficient number of sheets in the stack to create another bundle. Reduced movement in the elevator occurs where the time for formation of a bundle and the time for taking away a bundle by the elevator are approximately the same. In that event the elevator has to move only somewhat more than about the same distance as the width of the bundle, in order to insure that the top sheet of the bundle is separated from the bottom sheet of the stack which is continuing to be formed and to provide room, over the bundle on the elevator, for receiving the subsequently forming bundle on plate 28. In those cases where the removal of the bundle and the return of the elevator to the stack is significantly faster than the formation of the next bundle, the elevator receives only a partially formed bundle, and thus rises to a higher elevation in order to receive the bundle which is only partially formed.

Thus it is seen that the invention provides means for defining a bundle of interfolded sheets and separating it downwardly from the stack of interfolded sheets, in the proximity of the discharge area of the interfolding apparatus. The invention further provides means for confining the bundle, to restrict movement of sheets in the bundle, and particularly the top sheet, during the separation process, so that separation of the top sheet from the stack and its retention in the bundle, is assured.

Having thus described the invention, what is claimed is:

1. A process for separating a bundle of folded sheets from a stack of folded sheets, said stack being on a vertically displaceable elevator, said bundle having a predetermined number of sheets, said process comprising the steps:

(a) inserting a first separator plate into said stack, thereby defining said bundle;

(b) inserting a second separator plate into said stack above said first separator plate; and (c) cooperatively lowering said elevator and said first separator plate, such that said elevator and said first plate hold a bundle therebetween and said bundle is effectively separated from said stack.

2. A process as in claim 1 and including cooperatively lowering said first separator plate a first distance in cooperation with said elevator while said elevator and said first plate hold said bundle therebetween, thereby separating said bundle from said stack, and subsequently further lowering said elevator and said bundle while stopping the lowering of said first plate.

3. A process as in claim 2 and including the step of pushing said bundle off said elevator.

4. A process for receiving interfolded sheets directly from an interfolder as the sheets are being formed into a stack, and separating from the stack-forming area, a bundle of a predetermined number of sheets, said method comprising the steps of:

(a) forming said stack of interfolded sheets on an elevator raised to a stack-receiving position;

(b) inserting a first separator plate into said stack, thereby defining said bundle;

(c) inserting a second separator plate into said stack above said first separator plate; and (d) cooperatively lowering said elevator and said first separator plate, such that said elevator and said first plate hold said bundle therebetween and said bundle is effectively separated from said stack.

5. A process as in claim 4 and including cooperatively lowering said first separator plate a first distance in cooperation with said elevator while said elevator and said first plate hold said bundle therebetween, and thereby separate said bundle from said stack, and subsequently further lowering said elevator and said bundle while stopping the lowering of said first plate.

6. A process as in claim 5 and including the step of pushing said bundle off said elevator.

7. A process for forming a stack of interfolded sheets and separating a bundle from said stack, said bundle having a predetermined number of sheets, said process comprising the steps of:

(a) interfolding sheets on an interfolder and forming a stack of interfolded sheets on an elevator raised to a stack receiving position, at the discharge location of said interfolder, said elevator having a line of movement;

(b) lowering said elevator as sheets are added to said stack;

(c) inserting a first separator plate into said stack at a first elevation thereby defining said bundle between said first plate and said elevator;

(d) inserting a second separator plate into said stack above said first plate;

(e) continuing to accumulate said stack of sheets on said second plate; and (f) lowering said elevator and said first plate cooperatively such that said bundle is held between said first plate and said elevator and is separated from said stack.

8. A process as in claim 7 and including the step of stopping downward motion of said first plate at a second elevation and continuing the lowering of said elevator to a lower position.

9. A process as in claim 8 and including the step of withdrawing said first plate from said line of movement.

10. A process as in claim 8 and including the step of raising said first plate to said first elevation and reinserting said first plate below said second separator plate.

11. A process as in claim 9 and including the step of raising said first plate to said first elevation and reinserting said first plate below said second separator plate.

12. A process as in claim 10 and including the step of pushing said bundle off said elevator.

13. A process as in claim 11 and including the step of pushing said bundle off said elevator.

14. A process as in claim 12 and including the step of raising said elevator to a position just below said plates.

15. A process as in claim 13 and including the step of raising said elevator to a position just below said plates.

16. A process as in claim 14 and including the step of withdrawing said first and second plates from said stack, such that said forming stack is deposited onto said elevator.

17. A process as in claim 15 and including the step of withdrawing said first and second plates from said stack such that said forming stack is deposited onto said elevator.

* * * * *